US008272175B1

(12) United States Patent
Williams-Prades et al.

(10) Patent No.: US 8,272,175 B1
(45) Date of Patent: Sep. 25, 2012

(54) SECURE MODULAR SHELTER APPARATUS

(76) Inventors: Darlene Williams-Prades, Washington, DC (US); Michael A. Martin, Washington, DC (US)

( * ) Notice: Subject to any disclaimer, the term of this patent is extended or adjusted under 35 U.S.C. 154(b) by 37 days.

(21) Appl. No.: 12/906,628

(22) Filed: Oct. 18, 2010

(51) Int. Cl.
*E04H 1/12* (2006.01)
*E04B 1/00* (2006.01)

(52) U.S. Cl. ..... 52/79.1; 52/79.4; 52/80.1; 52/82; 52/200; 220/565; 220/62.11; 135/87; 135/94; 135/136; 135/900

(58) Field of Classification Search ..... 52/17, 79, 52/1 M, 79.4, 80.1, 80.2, 81.1, 82, 85, 81.6; 220/560.03, 62.11, 565; 135/87, 92, 93, 135/94, 136, 137–138, 900, 901
See application file for complete search history.

(56) References Cited

U.S. PATENT DOCUMENTS

| | | | | |
|---|---|---|---|---|
| 3,735,536 | A | 5/1973 | Bellasalma | |
| 5,363,608 | A | 11/1994 | Conlan | |
| 6,085,475 | A * | 7/2000 | Parks et al. | 52/169.6 |
| 6,349,510 | B1 * | 2/2002 | Haas et al. | 52/79.5 |
| 6,415,557 | B1 | 7/2002 | McCalley | |
| 7,063,582 | B2 * | 6/2006 | Boujon | 441/38 |
| 7,237,360 | B2 | 7/2007 | Moncho et al. | |
| 7,695,049 | B2 * | 4/2010 | Colborne | 296/161 |
| 2003/0009954 | A1 * | 1/2003 | Bradley | 52/79.1 |
| 2005/0284035 | A1 * | 12/2005 | DeOvando et al. | 52/79.1 |
| 2006/0055193 | A1 * | 3/2006 | Colborne | 296/24.3 |
| 2010/0050541 | A1 * | 3/2010 | Bright | 52/73 |

* cited by examiner

*Primary Examiner* — Jeanette E. Chapman

(57) ABSTRACT

The secure modular shelter apparatus can be used to shelter those at bus stops, on campuses, using ATM's, waiting for trains, making calls, smoking, and for a host of other uses. Importantly, the apparatus is self-contained and can be placed as chosen, by a forklift for example, and either connected to existing power as an alternative energy source or used as is while providing its own power. Security may be guaranteed by entry only allowed by card or other secure personal identification means known in the art. Radiant assisted heating and cooling are provided. Information readout is provided by a lighted panel that may also feature scrolling schedule lights. A panic button and receiver/transmitter are also provided so that emergency communication with professionals is possible when needed. Audio and auxiliary lighting are provided for those with sight and hearing hardships. Automatic interior climate controls provide for thermostatically controlled comfort.

8 Claims, 8 Drawing Sheets

SECURE MODULAR SHELTER APPARATUS

CROSS-REFERENCE TO RELATED APPLICATIONS

Not Applicable

FEDERALLY SPONSORED RESEARCH OR DEVELOPMENT

Not Applicable

INCORPORATION BY REFERENCE OF MATERIAL SUBMITTED ON A COMPACT DISK

Not Applicable

BACKGROUND OF THE INVENTION

Various types of public, private, and semi-private shelters have been provided, such as those in use as bus stop shelters and the like. The present apparatus provides advantages heretofore unknown in the art.

FIELD OF THE INVENTION

The secure modular shelter apparatus relates to shelters and more especially to a secure modular shelter especially useful in a bus stop and related environment.

SUMMARY OF THE INVENTION

The general purpose of the secure modular shelter apparatus, described subsequently in greater detail, is to provide a secure modular shelter apparatus which has many novel features that result in an improved secure modular shelter apparatus which is not anticipated, rendered obvious, suggested, or even implied by prior art, either alone or in combination thereof.

To attain this, the secure modular shelter apparatus can be used to shelter those at bus stops, on campuses, using ATM's, waiting for trains, making calls, smoking, and for a host of other uses. Importantly, the apparatus is self-contained and can be placed as chosen, by a forklift for example, and either connected to existing power as an alternative energy source or used as is while providing its own power. The features that solidify the uniqueness of the apparatus include solar panels and back up power sources. Security may be guaranteed by entry only allowed by card or other secure personal identification means known in the art. Radiant heating and cooling are provided. Lighting is secured by fastening means that prevent vandalism associated with lighting damage and removal. Information readout is provided by a lighted panel that may also feature scrolling schedule lights. A panic button is also provided so that emergency communication with professionals is possible when needed. Audio and auxiliary lighting are provided for those with sight and hearing hardships. Automatic interior climate controls provide for thermostatically controlled comfort. The NC unit may be attached to or within a side and may also be contained within the bubble.

Thus has been broadly outlined the more important features of the improved secure modular shelter apparatus so that the detailed description thereof that follows may be better understood and in order that the present contribution to the art may be better appreciated.

An object of the secure modular shelter apparatus is to provide shelter.

Another object of the secure modular shelter apparatus is to provide a shelter that is self-contained.

A further object of the secure modular shelter apparatus is to provide security.

An added object of the secure modular shelter apparatus is to provide automatic climate control.

And, an object of the secure modular shelter apparatus is to provide solar power.

Yet another object of the secure modular shelter apparatus is to provide communication for those impaired in various communication abilities.

Still another object of the secure modular shelter apparatus is to provide emergency communication.

These together with additional objects, features and advantages of the improved secure modular shelter apparatus will be readily apparent to those of ordinary skill in the art upon reading the following detailed description of presently preferred, but nonetheless illustrative, embodiments of the improved secure modular shelter apparatus when taken in conjunction with the accompanying drawings.

DETAILED DESCRIPTION OF THE DRAWINGS

With reference now to the drawings, and in particular FIGS. 1 through 7 thereof, the principles and concepts of the secure modular shelter apparatus generally designated by the reference number 10 will be described.

Figure 2:
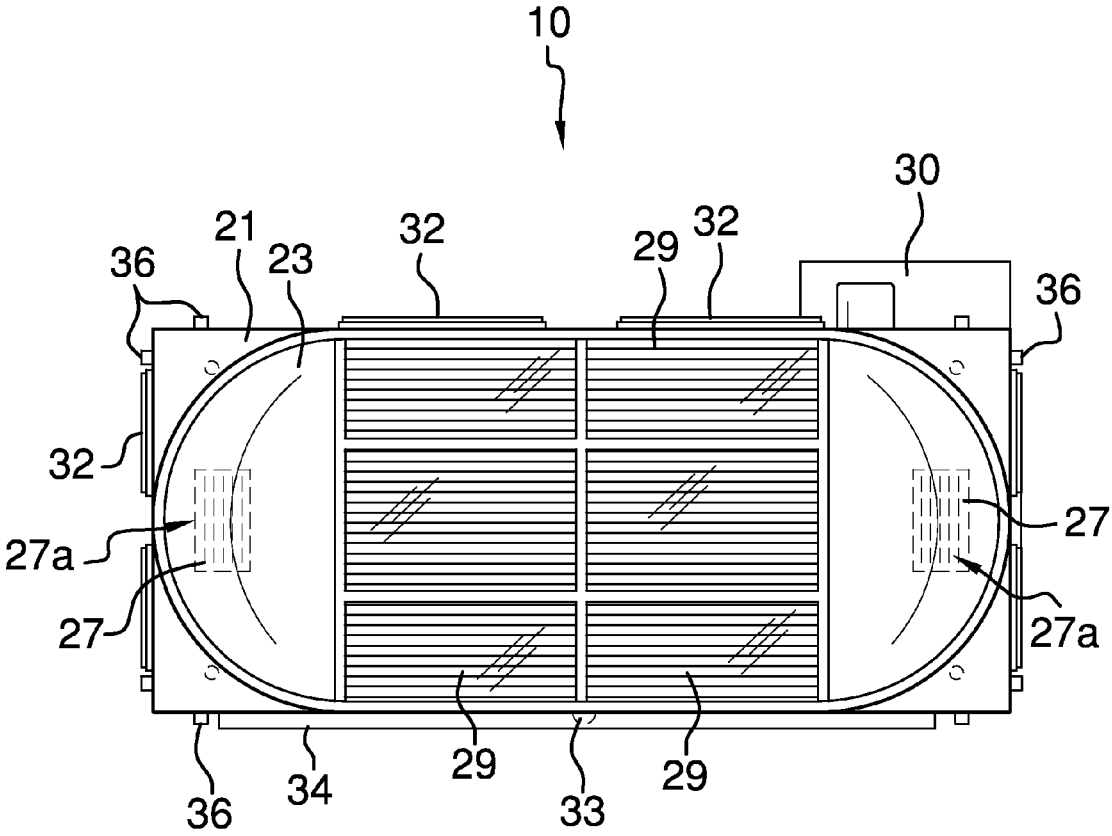
FIG. 2 is a top plan view.

Referring to FIG. 2, the apparatus 10 is a self-contained apparatus 10 that may be deposited where desired. Power may be derived and used from the apparatus 10 itself. The apparatus 10 may also access existing power. The apparatus 10 partially comprises a top 21 spaced apart from a floor 22 and a quartet of spaced apart transparent sides 20.

Referring again to FIG. 1A, the transparent sides 20 further comprise security mesh 26.

Figure 1:
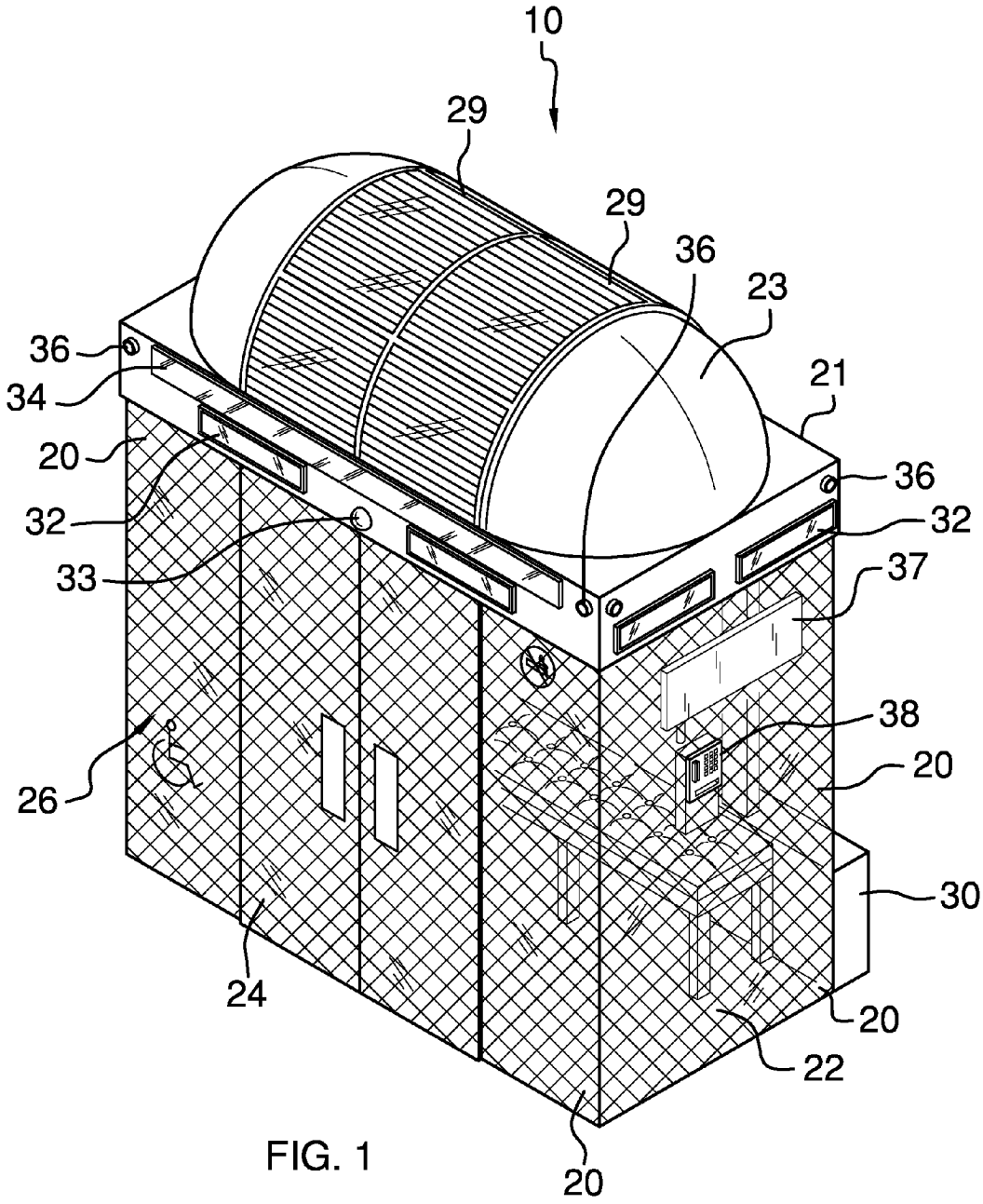
FIG. 1 is a top perspective view with security mesh within the sides and doors.

Referring to FIG. 3 and again to FIG. 1, the pair of opposed transparent sliding doors 24 is disposed within one side 20. Security mesh 26 is disposed within the doors 24. The bubble 23 is disposed upon the top 21 and provides extensive surface area for the solar panels 29. The plurality of solar panels 29 is disposed within the bubble 23.

Referring to FIG. 7 and again to FIG. 2, the plurality of vents 27 is disposed within the top 21. Each vent 27 has a filter 27*a*. A power backup 28 is provided and is disposed within the top 21. The power backup 28 is in communication with the solar panels 29. The NC unit 30 is in communication with the power backup 28 and the vents 27.

Referring again to FIG. 1*a*, the plurality of recessed light fixtures 32 is disposed within the top 21. The recessed light fixtures 32 are disposed above each side 20 and provide full lighting within and without the apparatus 10.

Referring again to FIG. 1*a* and FIG. 7, the plurality of cameras 36 is disposed within the top 21. The cameras 36 are in view of all sides 20, both exteriorly and interiorly.

Referring to FIG. 2, the exteriorly and interiorly visible information panel 34 is disposed within the top 21 and faces one side 20. The information panel 34 is visible both interiorly and exteriorly.

Figure 1A:
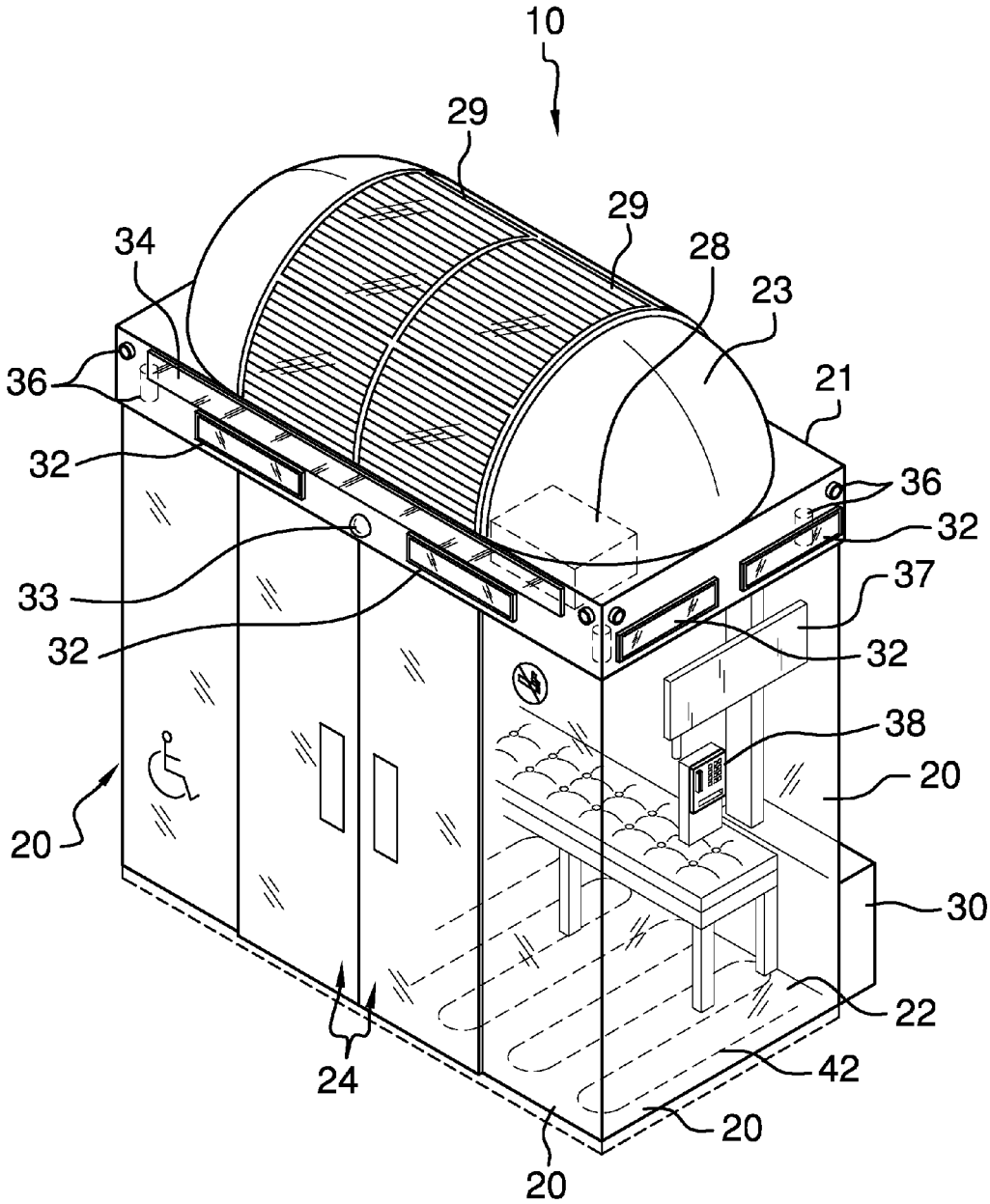
FIG. 1A is a top perspective view without security mesh sides and doors.

Referring to FIG. 5 and again to FIG. 1A, the display panel 37 is disposed within one side 20. The display panel 37 further comprises the panic button with alarm 46, the Braille communication insert 44, the speaker 45 with receiver/transmitter 49, the sanitizer dispenser 48, and the display 37*a*. The thermostat 47 is concealed within the display panel 37 so that it may be adjusted only by authorized personnel. The thermostat 47 automatically controls apparatus 10 interior temperature.

Figure 3:
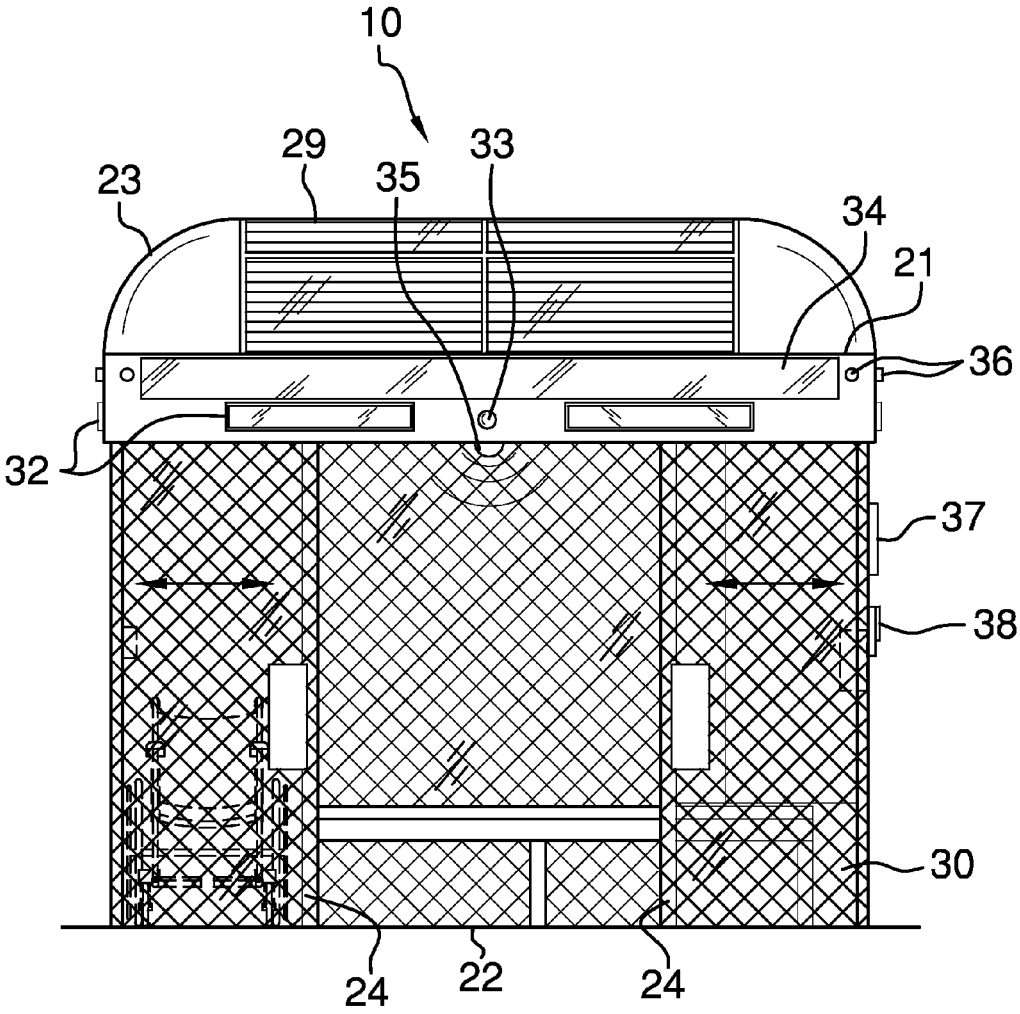
FIG. 3 is a front elevation view, doors open.
Figure 4:
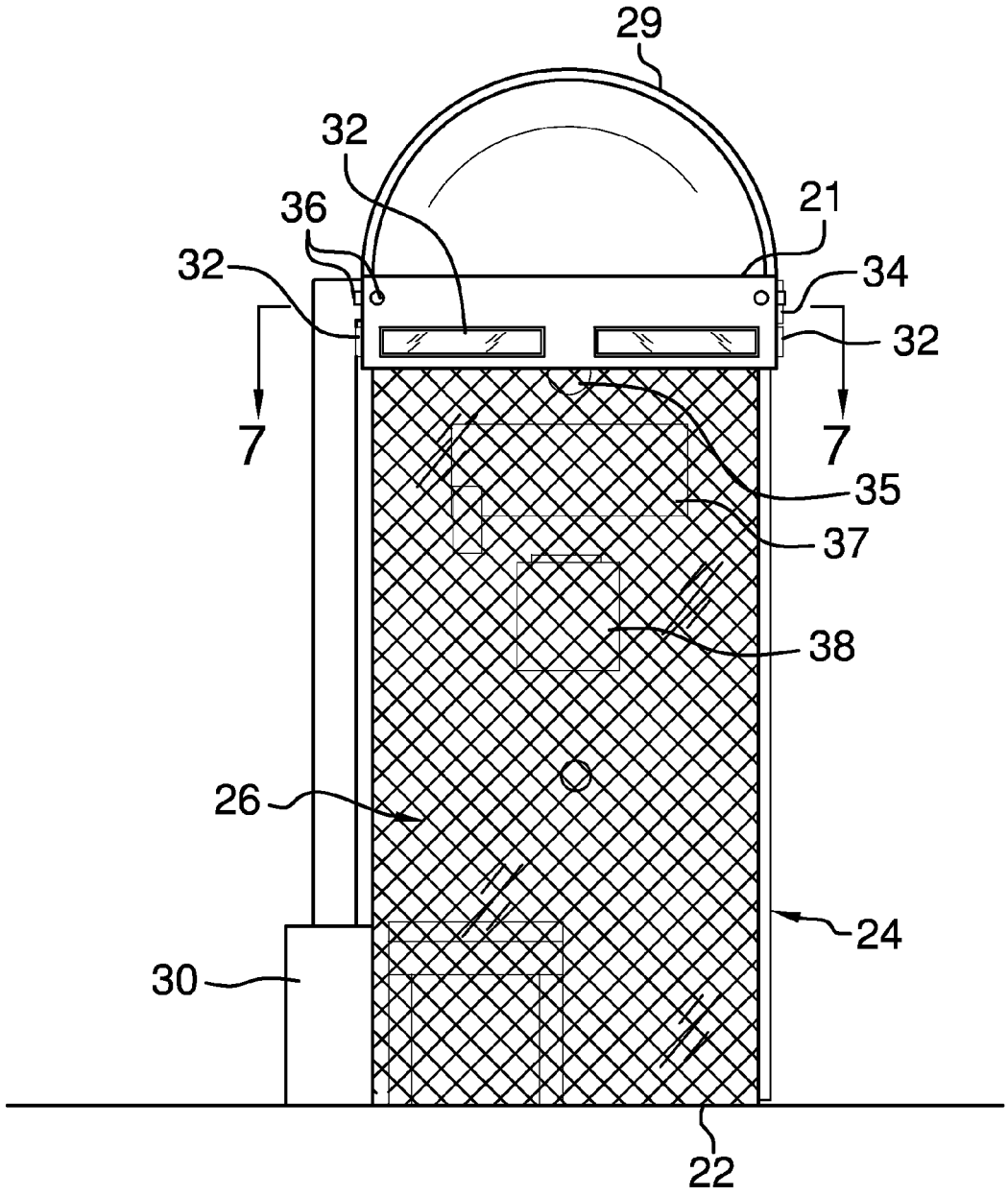
FIG. 4 is an end elevation view.
Figure 5:
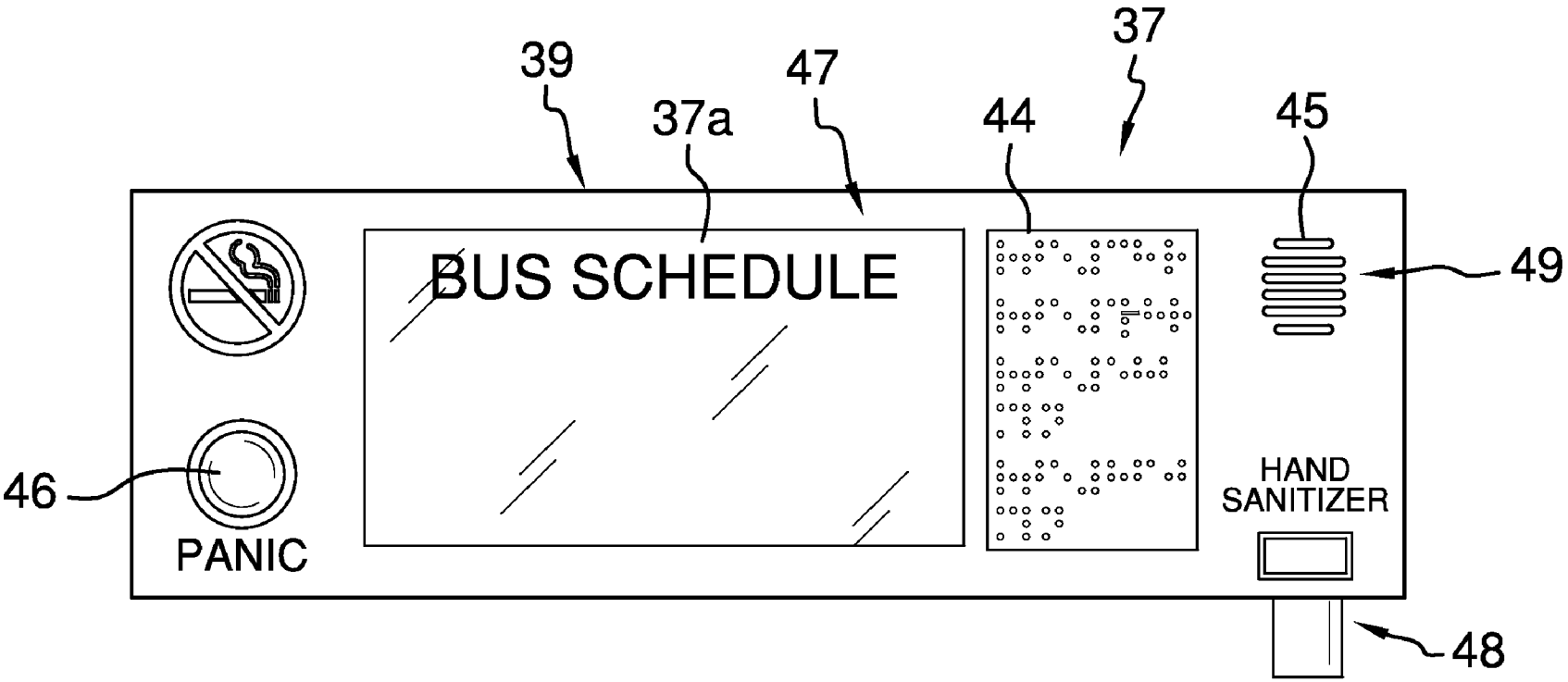
FIG. 5 is an elevation view of the display panel.

Referring to FIGS. 3 and 1A, the electronic panel 38 is disposed within one side 20. The electronic panel 38 provides identification only enabled entry into the apparatus 10. The panel 38 may provide other functions, such as ATM for example. The flashing light 33 is disposed above the doors 24 and may be used to alert users and those standing by of various events, schedules, schedule changes, and the like. The plurality of radiant coils 42 is disposed within the floor 22. The radiant coils 42 are in communication with the A\C unit 30.

Figure 6:
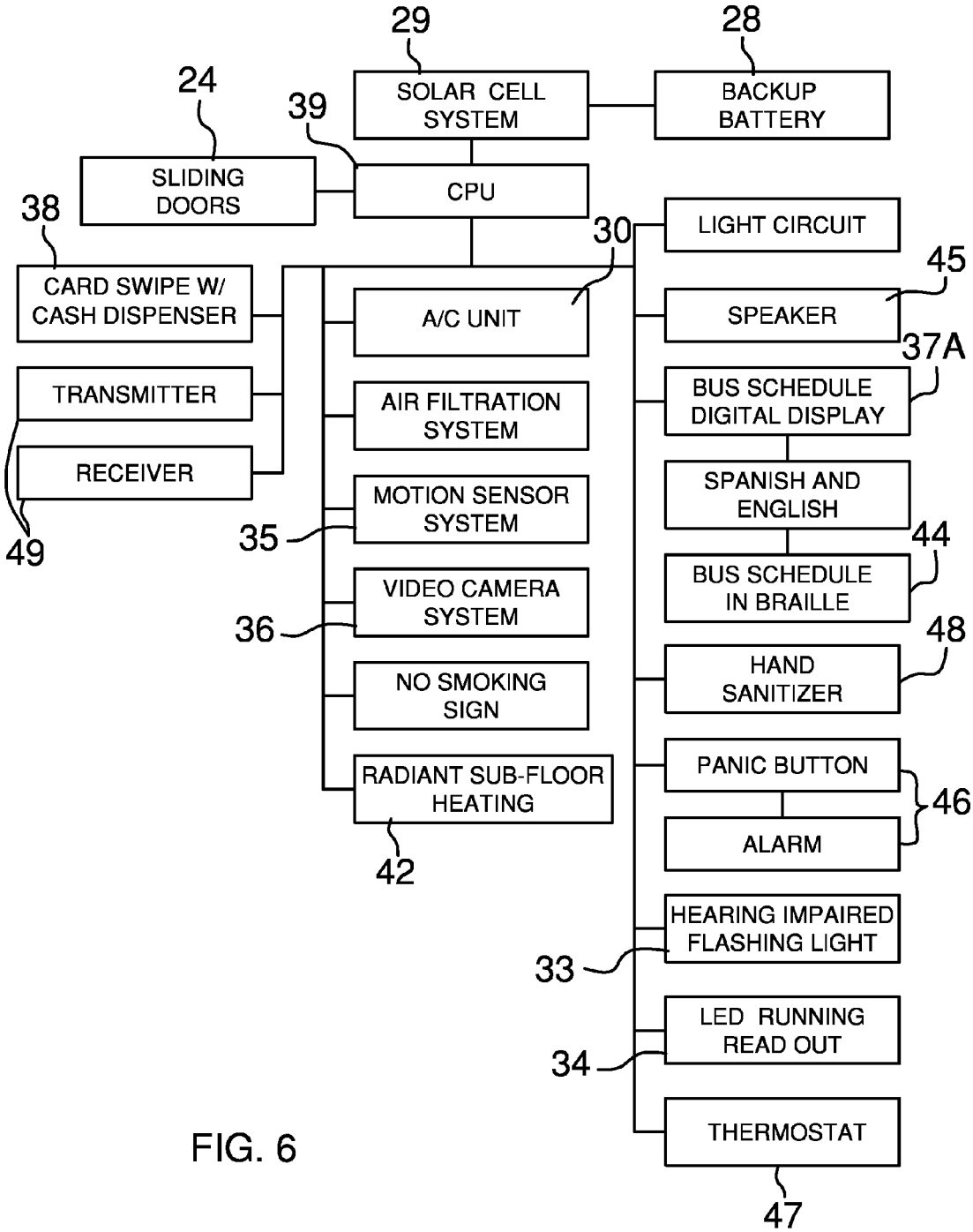
FIG. 6 is a schematic block diagram of components in communication.
Figure 7:
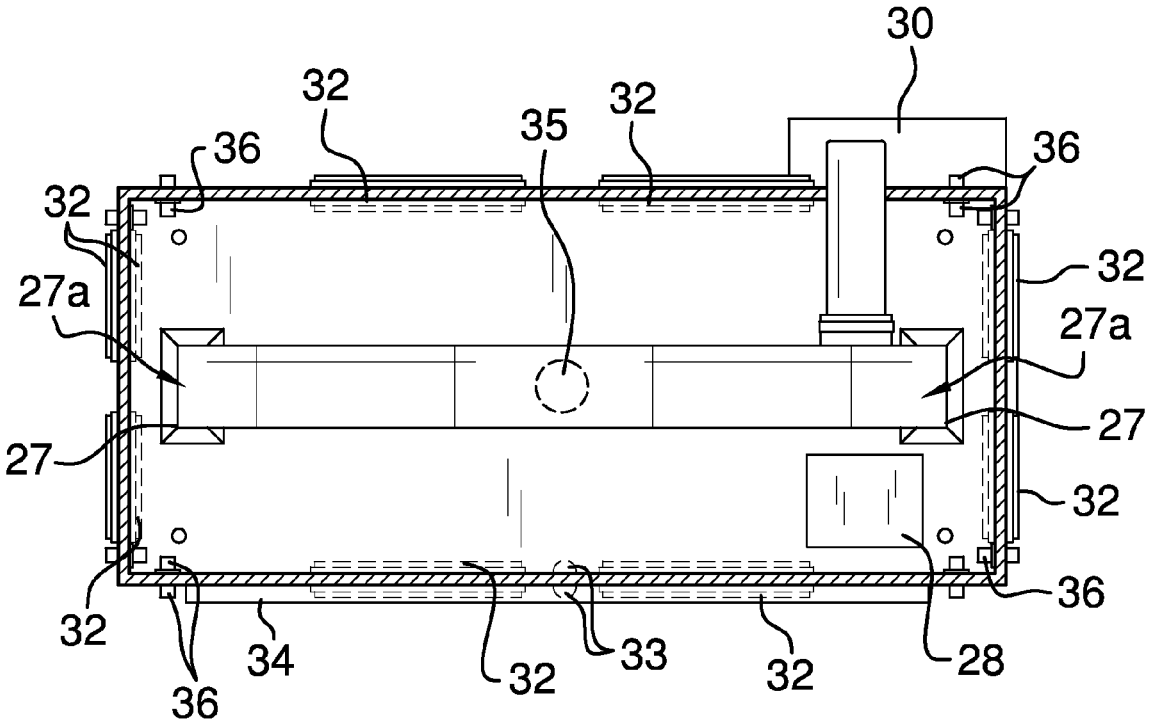
FIG. 7 is a top cross sectional view of FIG. 4, taken along the line 7-7.

Referring to FIGS. 6 and 1A, the cpu 39 is in communication with the electronic panel 38, the flashing light 33, the display panel 37, the information panel 34, the cameras 36, the light fixtures 32, the motion sensor 35, the NC unit 30, the power backup 28, the sliding doors 24, and the solar panels 29.

Directional terms such as "front", "back", "in", "out", "downward", "upper", "lower", and the like may have been used in the description. These terms are applicable to the embodiments shown and described in conjunction with the drawings.

These terms are merely used for the purpose of description in connection with the drawings and do not necessarily apply to the position in which the secure modular shelter apparatus may be used.

What is claimed is:

1. A secure modular shelter apparatus comprising, in combination:

a top spaced apart from a floor, and a quartet of spaced apart transparent sides;

a security mesh disposed within each side;

a pair of opposed transparent sliding doors disposed within one side;

a security mesh disposed within the doors;

a bubble disposed upon the top;

a plurality of solar panels disposed within the bubble;

a plurality of vents disposed within the top, each vent having a filter;

a power backup disposed within the top;

an A/C unit in communication with the power backup and the vents;

a plurality of recessed light fixtures disposed within the top, the recessed light fixtures disposed above each side, the recessed light fixtures providing exterior lighting;

a plurality of cameras disposed within the top, the cameras in view of all sides exteriorly and interiorly;

an exteriorly and interiorly visible information panel disposed within the top, facing one side;

a display panel disposed within one side, the display panel further comprising:

a panic button with alarm;

a Braille communication insert;

a speaker with receiver/transmitter;

a sanitizer dispenser;

a display;

a thermostat concealed within;

an electronic panel disposed within one side;

a motion sensor disposed above the doors;

a flashing light disposed above the doors;

a plurality of radiant coils disposed within the floor, the radiant coils in communication with the A/C unit;

a cpu disposed within the display panel and in communication with the electronic panel, the flashing light, the display panel, the information panel, the cameras, the light fixtures, the motion sensor, the A/C unit, the power backup, and the solar panels.

2. The apparatus according to claim 1 wherein the A/C unit is further disposed within the bubble.

3. The apparatus according to claim 1 wherein the light fixtures further provide light both exterior and interior to the apparatus.

4. The apparatus according to claim 2 wherein the light fixtures further provide light both exterior and interior to the apparatus.

5. The apparatus according to claim 1 wherein the information panel is further visible interiorly and exteriorly.

6. The apparatus according to claim 2 wherein the information panel is further visible interiorly and exteriorly.

7. The apparatus according to claim 3 wherein the information panel is further visible interiorly and exteriorly.

8. The apparatus according to claim 4 wherein the information panel is further visible interiorly and exteriorly.

* * * * *